US007289760B2

(12) United States Patent
Kotani

(10) Patent No.: US 7,289,760 B2
(45) Date of Patent: Oct. 30, 2007

(54) PRINTING DEVICE WITH MANUAL PAPER FEEDING FUNCTION

(75) Inventor: Masaki Kotani, Uji (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 249 days.

(21) Appl. No.: 10/999,527

(22) Filed: Nov. 29, 2004

(65) Prior Publication Data

US 2005/0145132 A1 Jul. 7, 2005

(30) Foreign Application Priority Data

Jan. 6, 2004 (JP) ..... 2004-000735

(51) Int. Cl.
*G03G 15/00* (2006.01)

(52) U.S. Cl. ..... 399/392; 399/389; 399/18; 271/9.09; 271/258.04

(58) Field of Classification Search ..... 399/16, 399/18, 19, 389, 392; 271/9.09, 258.01, 271/258.04; 400/708, 710
See application file for complete search history.

(56) References Cited

U.S. PATENT DOCUMENTS 5,826,156 A * 10/1998 Natsume et al. ..... 399/389
6,304,342 B1 * 10/2001 Komada ..... 358/448

FOREIGN PATENT DOCUMENTS

| | | |
|---|---|---|
| GB | 0 542 289 | 5/1993 |
| JP | 06-148990 | 5/1994 |
| JP | 06-337560 | 12/1994 |
| JP | 09-006186 | 1/1997 |
| JP | 11-292349 | 10/1999 |
| JP | 2001-117431 | 4/2001 |
| JP | 2002-296980 | 10/2002 |

* cited by examiner

*Primary Examiner*—Leslie J. Evanisko
(74) *Attorney, Agent, or Firm*—Hogan & Hartson LLP

(57) ABSTRACT

A printing device with a manual paper feeding function includes a manual paper feeding unit which feeds a plurality of papers, a size sensor which detects a paper size of a fed paper, a paper size error determining unit that determines a presence or an absence of a paper size error in accordance with a detected paper size of the fed paper and a set size, a next page determining unit that determines a presence or an absence of a next page to be printed in accordance with the determination of the presence of the paper size error in case of a manual paper feeding operation and a control unit that ignores the determination of the presence of the paper size error in case of the absence of the next page to be printed.

20 Claims, 4 Drawing Sheets

PRINTING DEVICE WITH MANUAL PAPER FEEDING FUNCTION

BACKGROUND OF THE INVENTION

1. Field of the Invention

The present invention relates to a printing device such as a copying machine, a Multi Function Peripheral (MFP) having multiple functions such as a copy function and a facsimile function and a printer device. In particular, the present invention relates to a printing device with a manual paper feeding function.

2. Description of Related Art

A copying machine and an MFP or the like may include a paper cassette and also a manual paper feeding unit. There are cases in which the copying machine and the MFP or the like carry out a copying operation and a printing operation by a manual paper feeding operation. In such a type of printing device, in case of carrying out the copying operation by the manual paper feeding operation, when the paper size recognized by the printer is different from the paper size of paper fed actually from the manual paper feeding unit, a paper size error is displayed. Accordingly, the user can again set the correct paper size. In case the manual paper feeding operation is a single manual feeding operation, even when the paper size error is detected, the error is ignored.

A known copying machine includes a status detecting unit for detecting the status of a manual paper feeding unit. When the status detecting unit detects the paper width of paper to be fed manually, candidates of the paper size of the paper to be fed manually can be confirmed. When one of the confirmed candidates of the paper size is selected by operating a key on an operation panel, the size of a. recording medium to be fed from a multiple manual paper feeding tray can be confirmed.

Conventionally, in case the manual paper feeding operation is a single manual feeding operation, even when a paper size error is generated, the error is ignored. As a result, usability of the user is not lowered. However, in case the manual paper feeding operation is a multiple manual feeding operation, when the generated paper size error is ignored and the printing operation continues, there are cases in which toner is discharged or a bias voltage is impressed even in the absence of paper. Moreover, a cleaning process is carried out frequently. As a result, the duration of a drum is shortened considerably. When a processing for the paper size error is carried out, a long period of time is taken by an operation for solving the error. As a result, the usability of the printing device is lowered.

SUMMARY OF THE INVENTION

The present invention has been made in consideration of the above-described drawbacks. An advantage of the present invention is to provide a printing device which can maintain usability of a user without considerably shortening duration of the printing device even when the paper size error is generated in a multiple manual feeding.

According to an aspect of the present invention, a printing device with a manual paper feeding function includes a manual paper feeding unit, a size sensor, a paper size error determining unit and a next page determining unit. The manual paper feeding unit feeds multiple sheets of papers. The size sensor detects a paper size of the fed paper. The paper size error determining unit determines the presence or the absence of the paper size error in accordance with the detected paper size of the fed paper and a set size. The next page determining unit determines whether or not to print a next page according to a determination of the presence of the paper size error in case of a manual paper feeding operation. In case of not printing the next page, the determination of the presence of the paper size error is ignored.

According to an aspect of the present invention, in the printing device with the manual paper feeding function, when a determination is made to print the next page, a current printing paper can be handled normally. To handle normally means to determine that a printing operation has been carried out properly, to count up a number of printed sheets and to proceed onto a next printing operation.

According to an aspect of the present invention, the printing device with the manual paper feeding function can further include a notification unit which urges to change a setting of a paper size. When a determination is made to print the next page, the notification unit can be operated.

According to the present invention, even when the paper size error is generated in the multiple manual feeding, a determination is made as to the presence or the absence of a page that is necessary to be printed next. In the case of the absence of a page that is necessary to be printed next, the paper size error is ignored and the current printing operation is determined successful. The printing device of the present invention is as usable as a conventional printing device with a single manual feeding function.

In the case of the presence of a page that is necessary to be printed next, the current printing operation is determined to be normal. Then, after notifying to change the setting of the paper size, by operating a restart key, a copying operation can be carried out for another sheet. Although the copying operation cannot be carried out consecutively, the copying operation can be continued and a decrease in operationality can be prevented.

DETAILED DESCRIPTION OF THE INVENTION

An embodiment of the present invention will be described.

Figure 1:
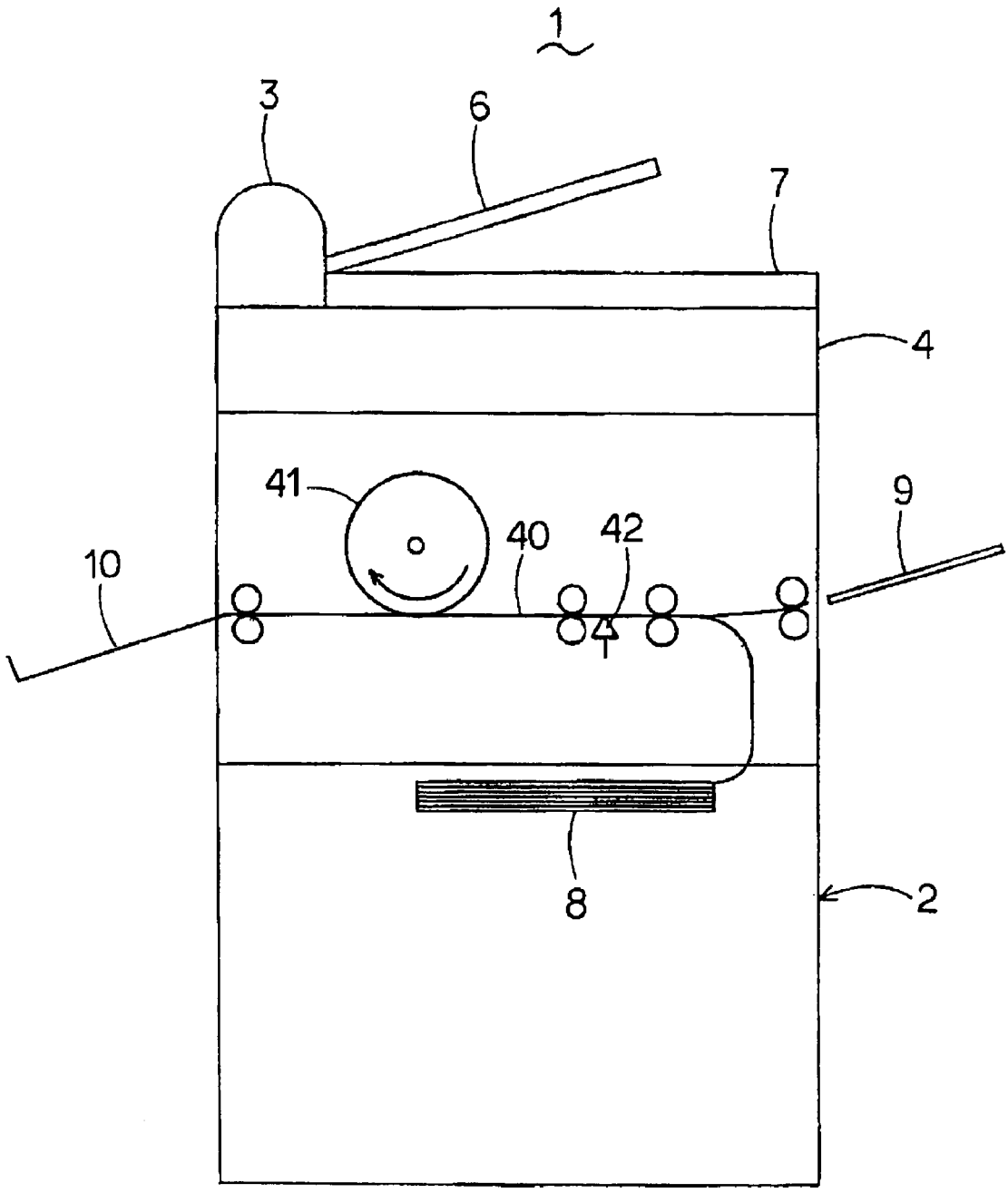
FIG. 1 is a schematic drawing of a facsimile machine (an MFP) as a printing device according to an embodiment of the present invention.

FIG. 1 is a schematic drawing of a facsimile machine as a printing device according to an embodiment of the present invention. The facsimile machine 1 is formed as a MFP having a facsimile function and a copy function. An Automatic Document Feeder (ADF) 3 is provided at one end on an upper part of a frame 2. A document feeding tray 6 and a document discharge tray 7 are provided on the upper part of the frame 2. An original document to be scanned is set on the document feeding tray 6. A scanned original document is discharged onto the document discharge tray 7. The ADF 3 and the trays 6 and 7 are connected integrally on the frame 2 by a hinge at a rear side of the frame 2 in a manner that a front side can be opened and closed. A Flat Bed Scanner (FBS) 4 is provided below the ADF 3 and the trays 6 and 7. The functions of these parts are not different from those of a conventional machine, and a description will be omitted.

A paper cassette 8 is provided in the frame 2 of the facsimile machine 1. The paper cassette 8 stores printing papers. A manual paper feeding unit 9 is provided at a side of the frame 2. A paper discharge tray 10 is provided at an opposite side of the frame 2. Paper 40 fed from the paper cassette 8 or the manual paper feeding unit 9 is printed by a photoconductive drum 41. The paper 40 on which an image has been printed is discharged onto the paper discharge tray 10. A size sensor 42 for detecting the length of the paper is provided along a paper transportation path.

Figure 2:
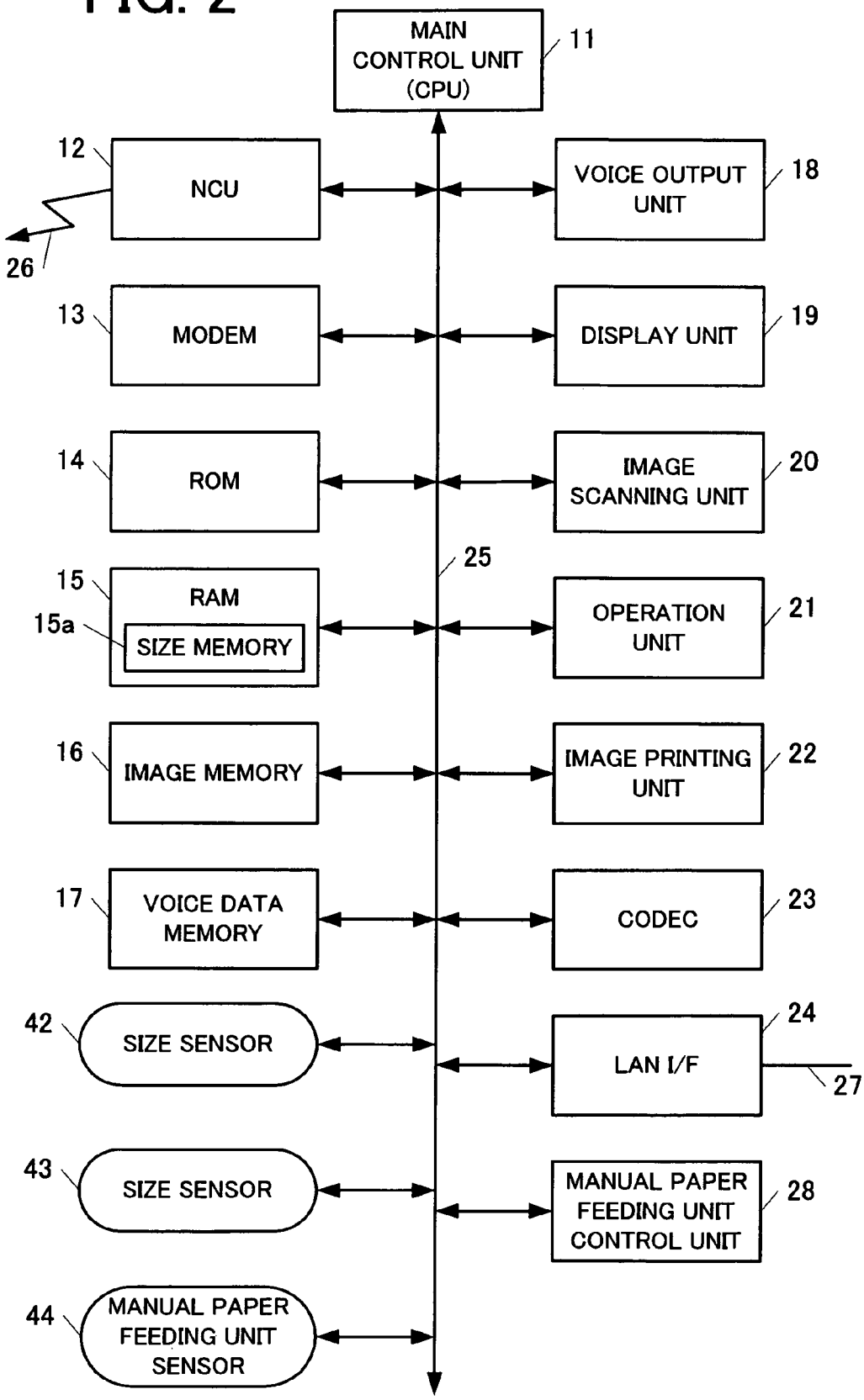
FIG. 2 is a block diagram showing an example of a structure of the facsimile machine according to the embodiment of the present invention.

FIG. 2 is a block diagram showing an example of a structure of the facsimile machine 1. The facsimile machine 1 includes a main control unit (a Central Processing Unit (CPU)) 11, a Network Control Unit (NCU) 12, a modem 13, a Read Only Memory (ROM) 14, a Random Access Memory (RAM) 15, an image memory 16, a voice data memory 17, a voice output unit 18, a display unit 19, an operation unit 20, an image scanning unit 21, an image printing unit 22, a codec 23, a Local Area Network Interface (LAN I/F) 24, a bus 25, a manual paper feeding unit control unit 28, size sensors 42 and 43 and a manual paper feeding unit sensor 44.

The main control unit 11 controls each of the units of the facsimile machine 1 in accordance with a program stored in the ROM 14. The main control unit 11 includes a paper size error detecting function. For example, the main control unit 11 detects that a paper size of the fed paper is a nonstandard size or that a detected paper size does not correspond with a preset paper size. The main control unit 11 also includes a manual paper feeding determining function. When detecting a paper size error, the main control unit 11 determines whether or not the fed paper is manually fed paper. The main control unit 11 also includes a function for detecting, when a paper size error is detected or when carrying out the manual paper feeding operation, the presence or the absence of a next page after copying one sheet. The main control unit 11 also includes a function for ending a process and ignoring the detected paper size error in case of the absence of the next page and handling the current printing paper normally in case of the presence of the next page. The main control unit 11 also includes a function for executing a paper size setting operation. Under a state in which the paper size error is detected, in case the paper is not fed manually or in case of the presence of the next page in the manual paper feeding, the main control unit 11 executes the paper size setting operation.

The NCU 12 controls a connection established with a telephone line 26. The NCU 12 includes a function for transmitting a telephone number (a corresponding dial signal) of a destination and a function for detecting an incoming call. The NCU 12 receives a dial tone signal, a calling tone (CNG) signal or the like from the telephone line 26. The modem 13 modulates transmission data and demodulates received data in accordance with V.17, V.27ter, V.29 or the like based on a facsimile transmission control protocol according to the International Telecommunication Union-Telecommunications (ITU-T) Recommendation T. 30.

The ROM 14 stores a program for controlling the entire facsimile machine 1. The RAM 15 temporarily stores various pieces of information relating to the facsimile machine 1. The RAM 15 includes a size memory 15*a* for storing a paper size of the paper to be fed. The image memory 16 temporarily stores received image data or image data scanned by the image scanning unit 21.

The voice data memory 17 stores voice data of various voice guidances. For example, the voice data is "Please change paper size to correct size." output in the paper size setting operation, and "Paper is jammed. Please remove the jammed paper." or "Paper is jammed." output when the paper is jammed. The voice output unit 18 outputs the voice guidance stored in the voice data memory 17 from a speaker or the like. The display unit 19 displays various pieces of information such as an operational status of the facsimile machine 1 and a transfer time. The operation unit 20 includes a ten-key numeric pad, a one-touch key, a start key and other various keys.

The image scanning unit 21 scans an image of an original document and outputs the image data. The image printing unit 22 is an electrophotographic printer. The image printing unit 22 prints onto printing paper, the received image data or the image data of the original document scanned by the image scanning unit 21 in the copying operation. The codec 23 encodes the transmission image data and decodes the received image data. The LAN I/F 24 transmits and receives various data via a LAN 27 with a remote device.

The manual paper feeding unit control unit 28 controls the operation of the manual paper feeding unit 9 provided in the frame 2. Specifically, when the manual paper feeding unit sensor 44 is switched on, the manual paper feeding unit control unit 28 detects that the manual paper feeding unit 9 has been opened. The manual paper feeding unit control unit 28 controls the paper feeding operation or the like in accordance with a command from the main control unit 11.

Figure 3:
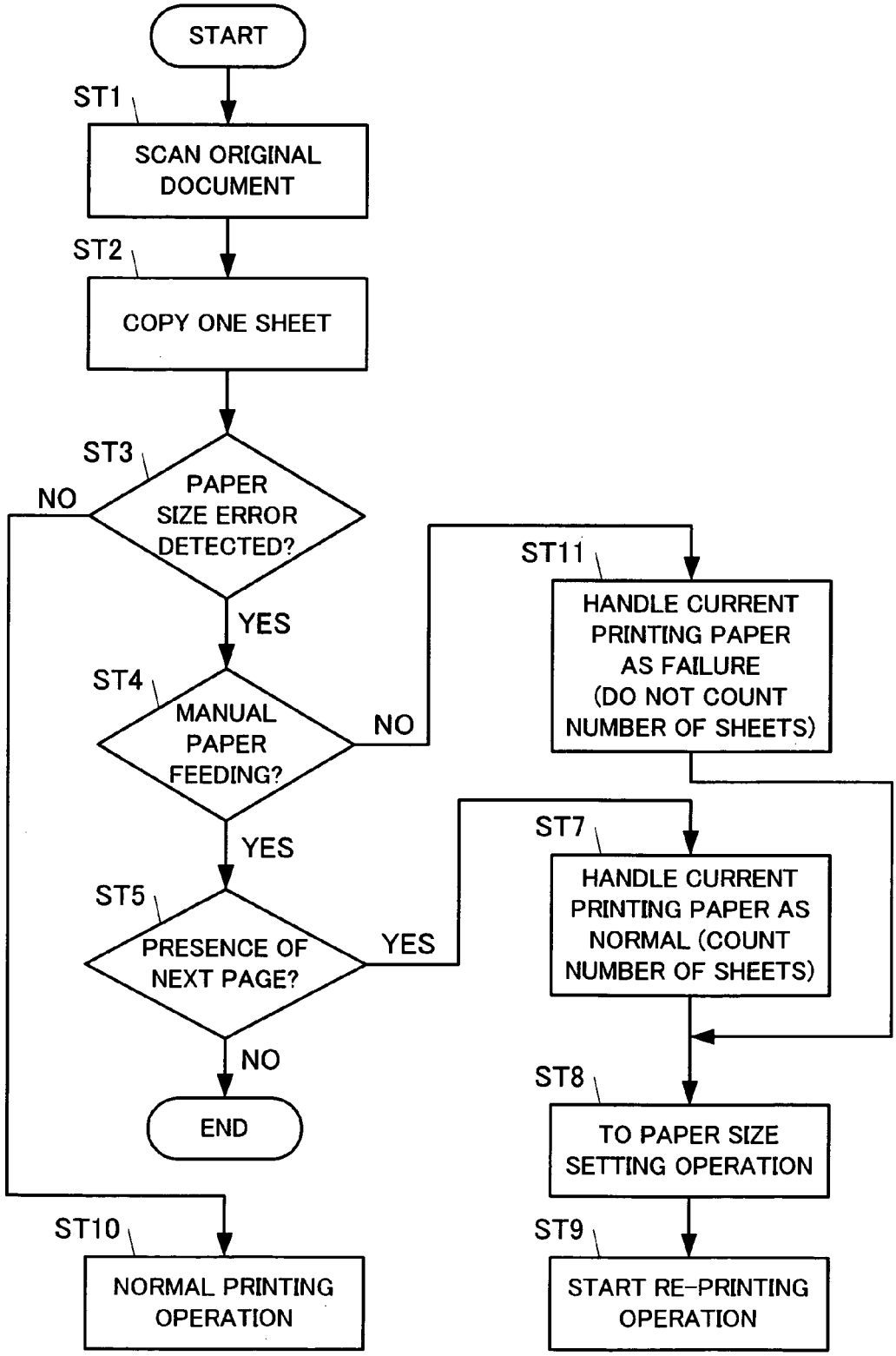
FIG. 3 is a flowchart of a processing operation carried out when feeding paper in the facsimile machine according to the embodiment of the present invention.

Next, referring to the flowchart of FIG. 3, the processing operation carried out in case of the manual paper feeding operation will be described. When the start key of the operation unit 20 is operated, the operation of this job starts. At step ST1, the image scanning unit 21 scans an original document. The scanned image is encoded by the codec 23 and stored into the image memory 16. Next, the process proceeds onto step ST2. At step ST2, the image printing unit 22 carries out a copying operation (a printing operation) of a first page onto the paper fed from the paper cassette 8 or the manual paper feeding unit 9. Next, the process proceeds onto step ST3.

At step ST3, a determination is made as to whether or not a paper size error is detected. The determination of step ST3 is carried out, for example, by detecting the paper size of the paper fed from the manual paper feeding unit 9 by the size sensors 42 and 43. The size sensor 42 detects the length of the paper. The size sensor 43 detects the width of the paper. If the paper size is a standard size, the paper size can be detected by the outputs from the sensors 42 and 43. However, for example, in case the width of the paper is not a standard width, there are cases in which the paper size cannot be determined. Even when the paper size is detected, if the detected paper size is different from a size expected (set) previously by the facsimile machine 1, a determination of the paper size error is made. In case the paper size error is not detected, the process proceeds onto step ST10. Meanwhile, in case the paper size error is detected, the process proceeds onto step ST4. At step ST10, a control process is carried out by an expected printing sequence. For example, a normal printing operation is carried out. In other words, papers are fed at an interval according to the set paper size.

At step ST4, a determination is made as to whether or not the paper is fed manually. This determination is carried out in accordance with whether or not the manual paper feeding unit 9 is opened from the frame 2. Although not shown in FIG. 1, a switch which is turned on when the manual paper feeding unit 9 is opened is provided as the manual paper feeding unit sensor 44. A switch signal of the manual paper feeding unit sensor 44 is loaded into the main control unit 11. In case of the manual paper feeding, the process proceeds onto step ST5. Meanwhile, in case the paper is not fed manually, the process proceeds onto step ST11.

At step ST5, a determination is made as to whether or not there is a next page. In case of the presence of the next page to be printed, for example, when making a plurality of copies of the same original document or when copying a plurality of original documents, the process proceeds onto step ST7. Meanwhile, in case of an absence of the next page, the process ends. As a result, even when a paper size error is detected in the copying operation of a single sheet, the detected error is ignored. Here, the data copied onto the paper of a size different from the set size remains as a copy result.

At step ST7, although the current printing paper is in a size that is different from the set size, the current printing paper is handled as normally printed paper. Accordingly, a number of printed pages is incremented by one. Next, the process proceeds onto step ST8.

Figure 4:
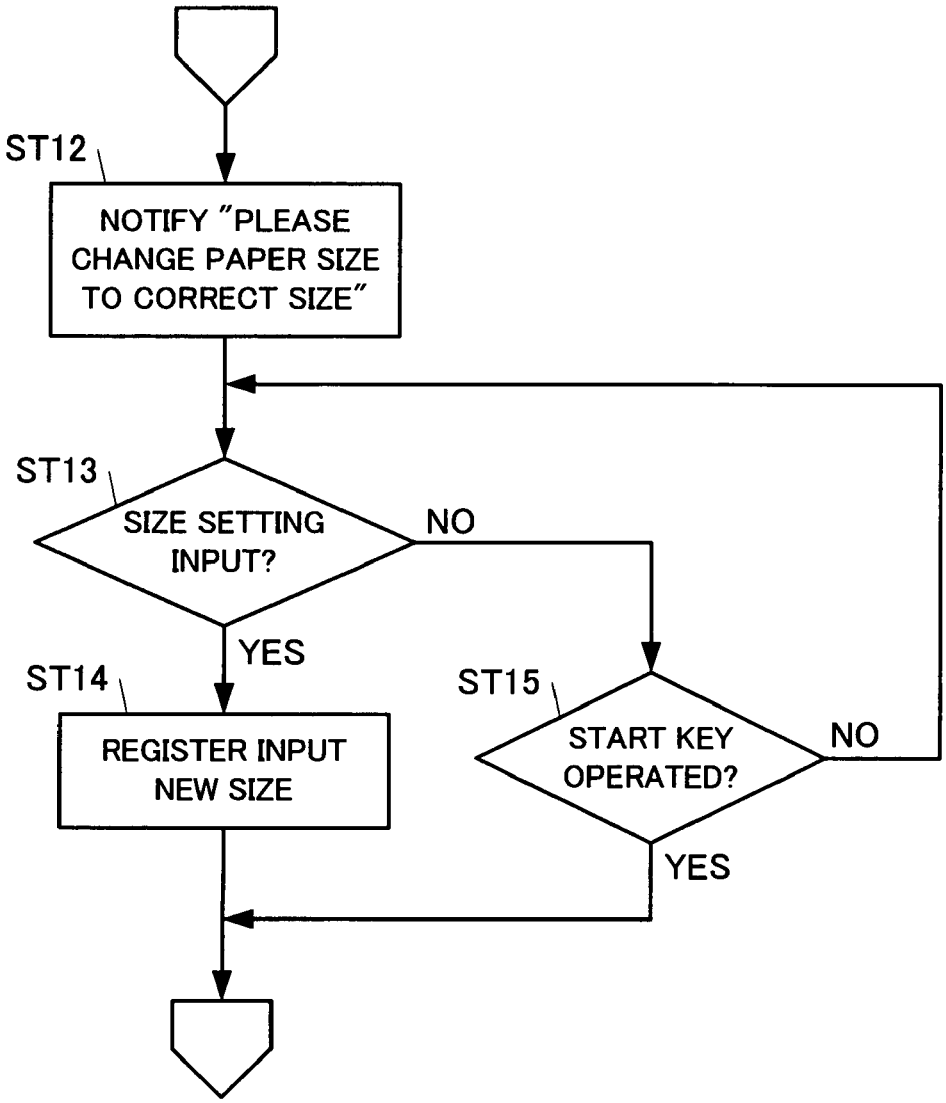
FIG. 4 is a flowchart showing a process carried out in a paper size setting operation of FIG. 3.

At step ST8, a paper size setting operation is executed. FIG. 4 shows contents of the paper size setting operation. Specifically, as shown in the flowchart of FIG. 4, at step ST12, a message "Please change paper size to correct size" is displayed on the display unit 19. In addition, this message is output in the form of a voice message from the voice output unit 18. Next, the process proceeds onto step ST13. At step ST13, a determination is made as to whether or not a change of the setting of the paper size has been input. When the change of the setting has been input by a user, the process proceeds onto step ST14. At step ST14, the input new paper size is registered. Then, the process proceeds onto step ST9. Meanwhile, when the change of the setting has not been input, the process proceeds onto step ST15. Under a state in which the change of the setting has not been input, at step ST15, a determination is made as to whether or not the start key of the operation unit 20 has been operated. When the start key has not been operated, the process returns to step ST13. Meanwhile, when the start key has been operated, the process proceeds onto step ST9 of FIG. 3 and a re-printing operation is started.

At step ST11, the current printing paper is determined to be a failure. Without counting the number of sheets, the process proceeds onto step ST8. In this case, the processes of FIG. 4 are executed in the same manner as described above.

The invention claimed is:

1. A printing device with a manual paper feeding function, comprising:

a manual paper feeding unit which feeds a plurality of papers;

a size sensor which detects a paper size of a fed paper;

means for determining a presence or an absence of a paper size error in accordance with a detected paper size of the fed paper and a set size;

means for determining a presence or an absence of a next page to be printed in accordance with the determination of the presence of the paper size error in case of a manual paper feeding operation; and means for ignoring the determination of the presence of the paper size error in case of the absence of the next page to be printed.

2. The printing device with the manual paper feeding function according to claim 1, wherein in case of the presence of the next page to be printed, a current printing paper is handled normally.

3. The printing device with the manual paper feeding function according to claim 2, further comprising:

means for notifying to change a setting of the paper size, wherein in case of the presence of the next page to be printed, the means for notifying is operated.

4. The printing device with the manual paper feeding function according to claim 3, wherein a restart key is activated for the means for notifying.

5. The printing device with the manual paper feeding function according to claim 2, further comprising:

means for determining that a printing operation came out properly;

means for counting up a number of printing sheets; and means for proceeding with a next printing operation.

6. The printing device with the manual paper feeding function according to claim 1, wherein the size sensor detects a length of the paper.

7. The printing device with the manual paper feeding function according to claim 1, wherein the size sensor detects a width of the paper.

8. The printing device with the manual paper feeding function according to claim 1, further comprising means for controlling the manual paper feeding unit to detect that the manual paper feeding unit is open.

9. A printing device with a manual paper feeding function, comprising:

a manual paper feeding unit which feeds a plurality of papers;

a size sensor which detects a paper size of a fed paper;

a paper size error determining unit that determines a presence or an absence of a paper size error in accordance with a detected paper size of the fed paper and a set size;

a next page determining unit that determines a presence or an absence of a next page to be printed in accordance with the determination of the presence of the paper size error in case of a manual paper feeding operation; and a control unit that ignores the determination of the presence of the paper size error in case of the absence of the next page to be printed.

10. The printing device with the manual paper feeding function according to claim 9, wherein in case of the presence of the next page to be printed, a current printing paper is handled normally.

11. The printing device with the manual paper feeding function according to claim 10, further comprising a notification unit that notifies to change a setting of the paper size, wherein in case of the presence of the next page to be printed, the notification unit is operated.

12. The printing device with the manual paper feeding function according to claim 11, wherein a restart key is activated for the notification unit.

13. The printing device with the manual paper feeding function according to claim 10, further comprising a control unit that determines a printing operation came out properly, counts up a number of printing sheets and proceeds with a next printing operation.

14. The printing device with the manual paper feeding function according to claim 9, wherein the size sensor detects a length of the paper.

15. The printing device with the manual paper feeding function according to claim 9, wherein the size sensor detects a width of the paper.

16. The printing device with the manual paper feeding function according to claim 9, further comprising a manual paper feeding control unit that controls the manual paper feeding unit to detect that the manual paper feeding unit is open.

17. A method for manually feeding paper, comprising:

feeding a plurality of papers;

detecting a paper size of a fed paper;

determining a presence or an absence of a paper size error in accordance with a detected paper size of the fed paper and a set size;

determining a presence or an absence of a next page to be printed in accordance with the determination of the presence of the paper size error in case of a manual paper feeding operation; and ignoring the determination of the presence of the paper size error in case of the absence of the next page to be printed.

18. The method for manually feeding paper according to claim 17, further comprising normally handling a correct printing paper in case of the presence of the next page to be printed.

19. The method for manually feeding paper according to claim 18, further comprising notifying to change a setting of the paper size in case of the presence of the next page to be printed.

20. The method for manually feeding paper according to claim 17, further comprising:

determining that a printing operation came out properly;

counting up a number of printing sheets; and proceeding with a next printing operation.

* * * * *